US005984114A

United States Patent [19]

Frankel

[11] Patent Number: 5,984,114

[45] Date of Patent: Nov. 16, 1999

[54] HEEL ELEVATING SUPPORT FOR A SHOE RACK

[75] Inventor: Doris N. Frankel, Pembroke Pines, Fla.

[73] Assignee: Designs By Dodi, Inc., Pembroke Pines, Fla.

[21] Appl. No.: 09/134,282

[22] Filed: Aug. 14, 1998

[51] Int. Cl.[6] ..... A47F 5/00

[52] U.S. Cl. ..... 211/34; 211/37; 211/131.1; 211/144; 211/163

[58] Field of Search ..... 211/34, 37, 163, 211/36, 144, 131.1

[56] References Cited

U.S. PATENT DOCUMENTS

| | | | |
|---|---|---|---|
| 2,613,735 | 10/1952 | Fisher | 211/36 X |
| 2,941,669 | 6/1960 | Palay et al. | 211/163 X |
| 2,973,867 | 3/1961 | Cohen | 211/37 |
| 3,874,512 | 4/1975 | Wegley et al. | 211/163 |
| 4,036,367 | 7/1977 | Stambaugh et al. | 211/37 |
| 4,232,790 | 11/1980 | Serrano | 211/163 X |
| 5,050,746 | 9/1991 | Frankel | 211/34 |
| 5,312,003 | 5/1994 | Domenig | 211/131.1 X |
| 5,562,216 | 10/1996 | Falconio | 211/131.1 X |

FOREIGN PATENT DOCUMENTS

| | | | |
|---|---|---|---|
| 411053 | 5/1934 | United Kingdom | 211/37 |

*Primary Examiner*—Robert W. Gibson, Jr.
*Attorney, Agent, or Firm*—William E. Noonan

[57] ABSTRACT

A shoe rack includes an elongate shaft that is supported to extend generally vertically relative to the floor. A plurality of generally horizontal shelves are mounted to and disposed about the shaft such that the shaft extends generally centrally through the shelves. A heel elevating support includes a fastener section that is attached directly to the shaft above a respective shelf. A support rail is spaced outwardly from the fastener and extends at least partly about the shaft. An intermediate section interconnects the fastener section and the rail section such that the rail section is supported above the respective shelf. The rail section is engaged by the heel of a shoe stored on a respective shelf to elevate and support the heel of the shoe above the shelf.

18 Claims, 4 Drawing Sheets

HEEL ELEVATING SUPPORT FOR A SHOE RACK

FIELD OF THE INVENTION

This invention relates to an improved heel elevating support for a shoe rack and, more particularly, to a support that is adjustably mounted on the central shaft of a rotary shoe rack.

BACKGROUND OF THE INVENTION

Storing and organizing footwear has traditionally presented a number of problems. Closet space is often used inefficiently and shoes tend to become strewn about the floor of the closet. Locating and picking up shoes is usually quite aggravating.

My U.S. Pat. No. 5,050,746 (hereinafter, Patent No. '746) addresses and overcomes a number of these problems. That patent relates to a rotary shoe rack wherein a number of shoe supporting shelves are mounted along a vertical shaft that is rotatably mounted in a closet or other storage space. Each shelf of that apparatus carries a heel elevating support that is engaged by the heels of the shoes stored on the shelf. The support specifically disclosed in Patent No. '746 comprises a ring that encircles the shaft. The ring is mounted on the shelf by a plurality of support posts that are attached to an inner portion of the shelf. As explained in the patent, by elevating a heel portion above the shelf platform, proper ventilation is maintained around the shoe so that mildew does not collect on the sole of the shoe. Moreover, elevating the heel increases the inner circumference of the arrangement of shoes and therefore permits a greater number of pairs to be accommodated on each shelf.

Although my previously disclosed heel elevating support works quite well, it exhibits several drawbacks. Most significantly, the support is not vertically adjustable. The heels of the stored shoes are raised to a fixed height above the shelf. The support cannot be adjusted relative to the shelf, in order to accommodate different shoe sizes, men's and women's shoes and varying numbers of shoes as desired. In some cases larger sized footwear does not fit properly on the shelf because the heel support is fixed too low and the shoes extend beyond the periphery of the shelf. Additionally, my previous design requires that a number of posts be interconnected between the shelf and the heelsupporting rail. Manufacturing and assembling the apparatus can be fairly time consuming and tedious. I have also determined that an aesthetically improved heel rail support would be desirable.

SUMMARY OF THE INVENTION

It is therefore an object of the present invention to provide an improved heel elevating support that is especially advantageous for use in a shoe rack of the type disclosed in U.S. Pat. No. 5,050,746.

It is the further object of this invention to provide a shoe rack having a heel elevating support that is vertically adjustable so that assorted sizes and numbers of shoes can be conveniently and attractively stored.

It is the further object of this invention to provide a shoe rack having a heel elevating support, which is quick and convenient to assemble, disassemble and adjust, as required, and which has an aesthetically attractive appearance.

It is the further object of this invention to provide a shoe rack that effectively stores a large amount of shoes in a neat, secure and organized manner within a closet, cabinet or other storage space.

It is the further object of this invention to provide a shoe rack that provides for improved, efficient use of storage space.

It is the further object of this invention to provide a shoe rack that permits even large numbers of shoes to be quickly and conveniently inspected It is the further object of this invention to provide a shoe rack that protects shoes against dust and mildew.

It is the further object of this invention to provide a shoe rack that is conveniently and readily assembled, disassembled and cleaned.

It is the further object of this invention to provide a shoe rack that may be constructed in various forms and sizes and employed in a wide variety of storage spaces, closets, cabinets etc., and which alternatively may be used as a free standing unit.

This invention results from the realization that footwear may be stored on a rack of the type disclosed in U.S. Pat. No. 5,050,746 in a much improved manner by utilizing a heel elevating support that is vertically adjustable along the central shaft of the shoe rack. Such a component permits the rack to be quickly and conveniently adjusted to accommodate various shoe sizes and numbers of shoes.

This invention features a heel elevating support for use in a shoe rack that includes a generally vertically supported shaft and a generally horizontal storage shelf mounted to and disposed about the shaft such that the shaft extends generally centrally through the shelf. The support includes a fastener section attached directly to the shaft above the shelf. There is a support rail section spaced outwardly from the fastener section and extending at least partly about the shaft. An intermediate section interconnects the fastener section and the rail section such that the rail section is supported above the respective shelf. The rail section is engaged by the heel of the shoe stored on the respective shelf to elevate and support the heel of the shoe above the shelf.

In a preferred embodiment, the fastener section includes means for releasably attaching the support to the shaft at a selected position along the shaft. The fastener section may include a generally annular collar that surrounds the shaft. The generally annular collar may carry means for releasably attaching the support to the shaft at a selected position along the shaft. The rail section may include a ring component that surrounds the shaft. The intermediate section may include a plurality of spokes that interengage the fastener section and the rail section. Each spoke may have an angular shape including a first segment that extends radially outwardly from the fastener section and a second segment that is attached to and extends upwardly from the distal end of the first segment. The second segment may have a distal end that is attached directly to the rail section. Straight spokes may also be used.

The present invention also features a shoe rack including the heel elevation support described above. Preferably, the shelf further includes a lip disposed generally peripherally about the shelf. The lip confines shoes mounted on the shelf and engaged with the heel elevating support within the periphery of the shelf.

BRIEF DESCRIPTION OF THE DRAWINGS

Other objects, features and advantages will occur from the following description of preferred embodiment and the accompanying drawings, in which.

DETAILED DESCRIPTION OF PREFERRED EMBODIMENTS

Figure 1:
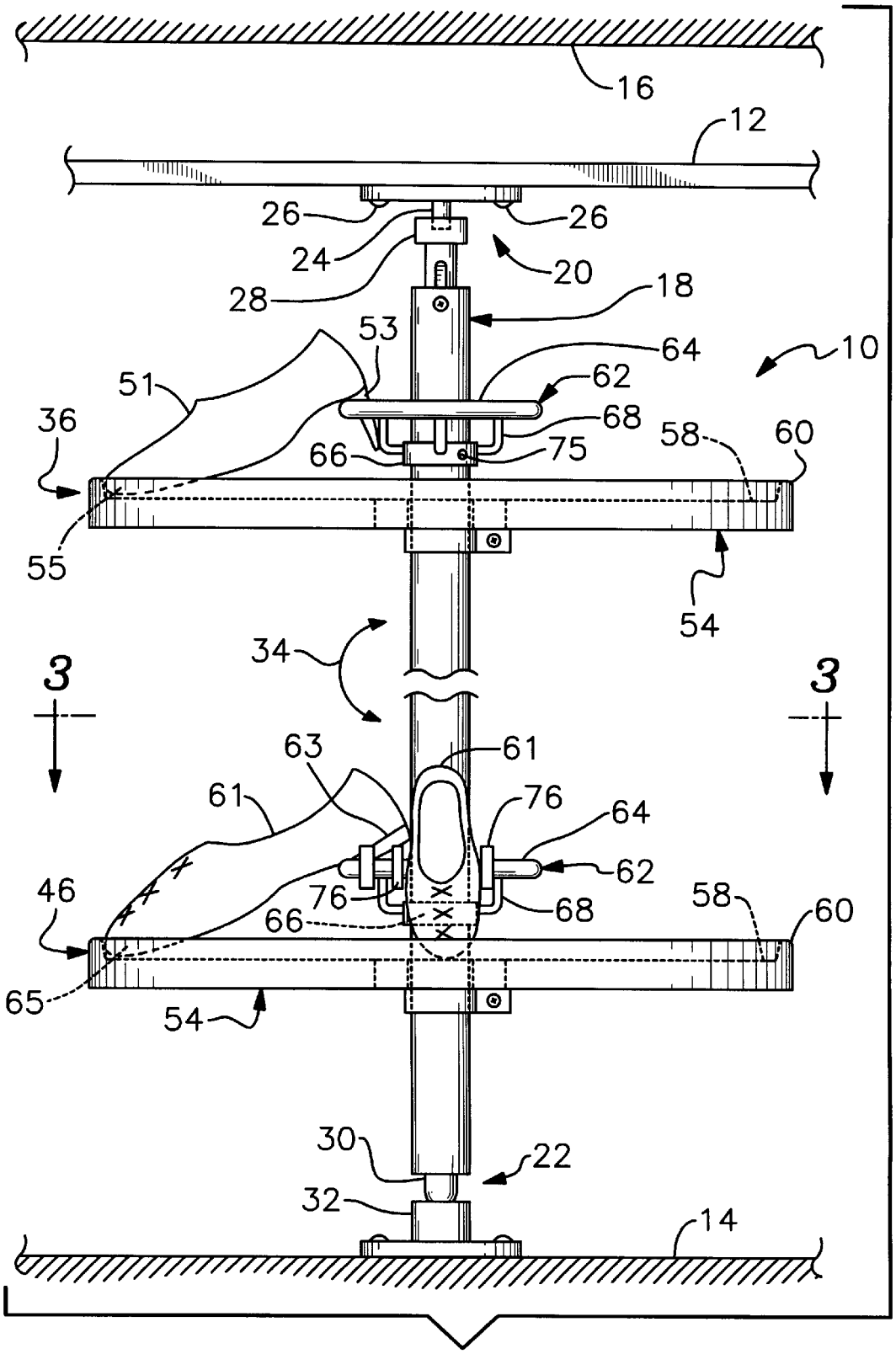
FIG. 1 is a partial, elevational view of one version of a shoe rack employing the improved heel elevating support of this invention.

A shoe rack according to this invention is constructed by mounting or otherwise supporting an elongate shaft such that it extends generally vertically relative to the floor. Vertically supporting the shaft may be accomplished in a wide variety of ways. For example, as disclosed in Patent No. '746, the shaft may be mounted between fixed upper and lower surfaces of a storage space. Such fixed upper and lower surfaces may comprise a ceiling and floor of a residential wardrobe closet. Alternatively, the fixed upper surface may include the bottom of a conventional storage shelf in the closet. In other versions, the shaft may be mounted by various means to a stand or platform that engages the floor. The shaft may be free standing and the upper end of the shaft need not be connected or attached to any component. In still other versions, the upper and lower ends of the shaft may be secured by brackets or other means to a vertical wall located in a closet or other storage space. The vertical shaft may also be mounted in a fixed or portable cabinet. In such versions, the elongate shaft is typically mounted in between generally plainer upper and lower wall members.

As disclosed in Patent No. 746, the shaft is typically supported such that it is axially rotatable. This is accomplished by utilizing various types of bearings to mount the lower and/or upper ends of the shaft. These may comprise, for example steel-delrin pivot bearings, such as are used in rotatable pantry shelves. A wide variety of alternative bearings may also be employed. It should also be noted, that in some versions the shaft may be fixed. In such cases, the shelves, which are described below, are typically rotatably mounted to the shaft by appropriate bearings.

Two or more storage shelves are secured to the shaft at spaced apart intervals for supporting respective groups of shoes. In alternative embodiments, a single shelf may be used. Each shelf is preferably circular in shape and is disposed entirely about the shaft. The shelf includes a generally horizontal and preferably solid, planar upper surface.

The improved heel support structure of this invention is mounted to the shaft and used in association with a respective shelf. The heel support is formed about the shaft, preferably in an annular arrangement, for elevating shoes placed on the shelf. As a result, the forward portion of each shoe is engagable with an outer section of the shelf. As used herein, the heel portion of the shoe refers to the heel itself or to a region located generally beneath the wearers' heel. The forward portion of the shoe generally refers to that portion of the shoe proximate the toe or ball of the foot. Because the heels of the shoes are elevated above the shelf, storage capacity is increased considerably and proper ventilation is maintained around the shoes and mildew is resisted. Storage capacity is increased because the inner circumference formed by the heels of the shoes is increased. As a result, a greater number of shoes may be arranged about each shelf. The heel support includes a fastener section, typically comprising an annular collar that is releasably attached to the shaft. In certain embodiments, the collar or other fastener section may be fixed to the shaft. An annular support rail section is spaced outwardly from the fastener section and extends at least partly about the shaft. An intermediate section, typically comprising one or more spokes, interconnects the fastener section and the rail section as such that the rail section is supported above the respective shelf. The spokes may be either straight or formed at an angle such that the annular rail is held above its associated fastening collar. Typically, the entire support may be composed of a unitary molded plastic although various other materials such as metals and metal alloys may be utilized. In certain versions, the collar, intermediate spokes or other connecting means, and the outer rail may comprise separate and distinct components.

Although in all embodiments described herein a circular or annular heel support is disclosed, in alternative embodiments the heel support may have other (e.g. square, octagonal, pentagonal etc.) configurations. Such heel supports are particularly useful for men's shoes, which typically have larger heels that may not fit well on a circular support.

Preferably, the heel support is adjustable around the shaft. Such adjustability is accomplished by using some type of means for releasably attaching the collar or other fastener to a selected location along the shaft. Such means for releasably attaching may include various types of releasable screws, clamps, springs, bolts and clips, the precise construction of which will be obvious to persons skilled in the art. The particular details for means for attaching the heel support to the shaft do not constitute a limitation of this invention. Various forms of releasable connectors may be used.

Preferably, a lip or ridge is formed peripherally about the platform. The lip forms a peripheral border for the shelf so those shoes that are placed on the shelf are confined within the periphery of the shelf. As a result, the shoes are prevented for slipping or being knocked from the shelves. Typically, the lip is formed integrally with the shelf and may be formed continuously or intermittently about the shelf. The shelf, including the platform and lip, is preferably composed of a rugged and yet preferably lightweight molded plastic material that resists rusting, although alternative materials may be used. Preferably the material should be easy to clean and resistant to mildew, staining and damage.

The shelves are secured at selected intervals along the shaft. Preferably, a releasable bracket or some other means is employed so that the location of the shelves may be adjusted to remove, add, or reposition a shelf as required. Each shelf is typically attached securely to the shaft so that all of the shelves rotate in unison with the shaft. As a result, the homeowner is able to rotate the entire apparatus and view all of the shoes quickly and conveniently. The apparatus presents a neat, attractive and organized appearance, unlike the cumbersome racks of the prior art.

There is shown in FIG. 1 a rotary shoe rack 10 that is mounted between generally horizontal upper and lower surfaces 12 and 14, respectively. These surfaces may be located in a conventional residential closet or other storage space. More particularly, surface 12 may comprise a closet shelf. Alternatively, the upper end of rack 10 may be mounted to the ceiling 16 of the closet. In other embodiments, surfaces 12 and 14 may comprise the upper and lower walls of a cabinet. In still other version, one or both of the fixed surfaces may be eliminated.

It should be understood that rack 10 may comprise a significant amount of the structure disclose in Patent No.

'746. The description contained in that patent is incorporated herein by reference. Rack 10 includes an elongate shaft 18 that extends generally between upper surface 12 and lower surface 14. The shaft is rotatably attached at its upper and lower ends to surfaces 12 and 14, respectively, by bearings 20 and 22. Bearing 20 comprises a pivot element 24 carried by a mounting plate that is mounted to closet shelf 12 by screws 26 and a bearing socket 28 that is formed at the upper end of shaft 18 for pivotably receiving element 24. If the surface 12 is a wire or ventilated shelf, appropriate alternative means may be employed to mount the bearing 20 to the shaft. The lower end of shaft 18 carries an element 30 that rotatably engages bearing socket 32, which is attached to floor 14. With the upper and lower ends of shaft 18 pivotably mounted to shelf 12 and floor 14, in this manner, the shaft is permitted to rotate in the direction of double headed arrow 34.

As previously described, shaft 18 may be mounted by alternative fixed or rotatable mounting components, known in the art, to other fixed structures, such as an adjacent wall or simply the floor. In any event, the shaft should be supported such that it is disposed vertically relative to the floor. The length of the shaft may be adjusted as described in Patent No. '746 or otherwise. In alternative preferred versions, the shaft may have a fixed length.

Figure 2:
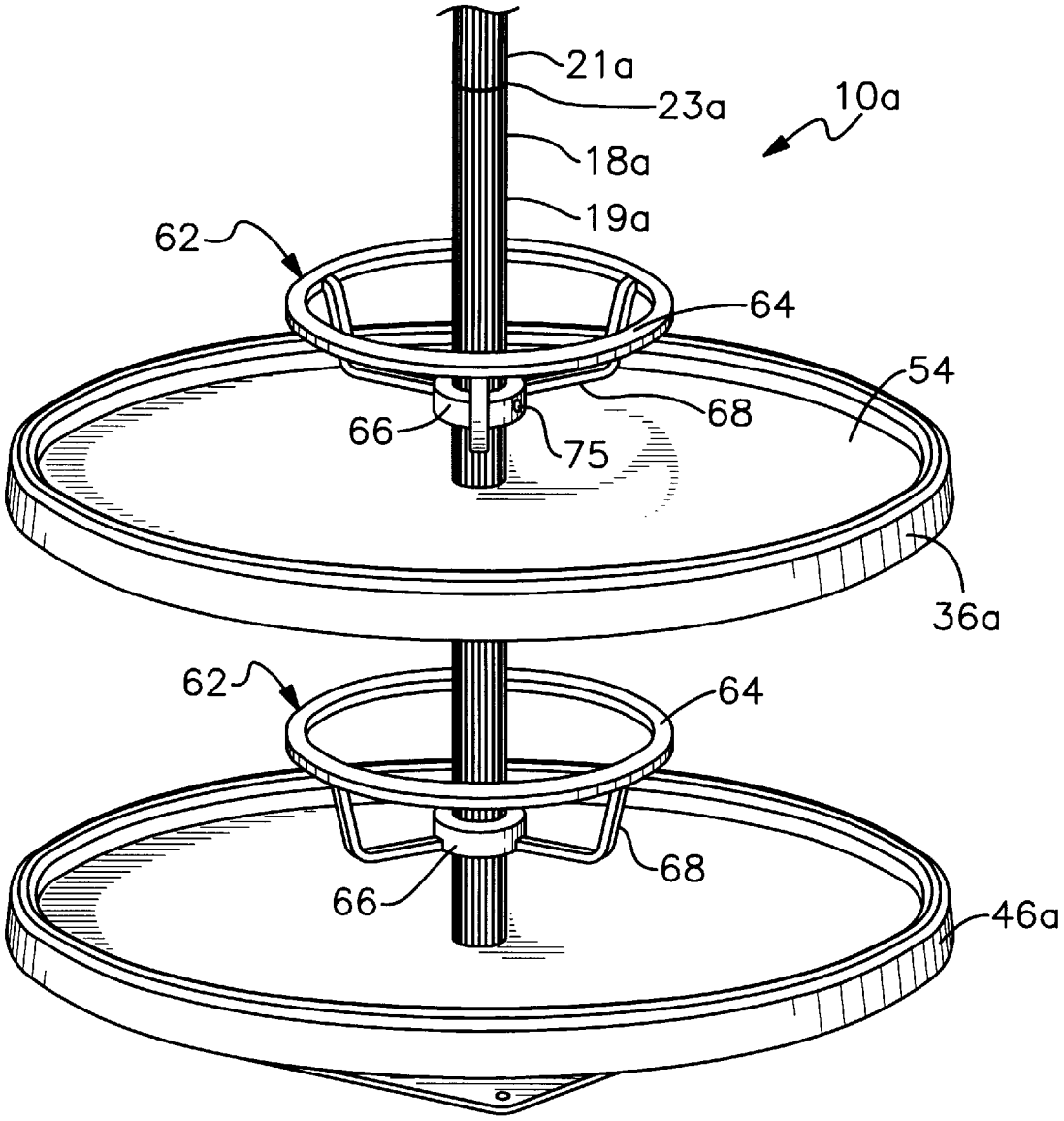
FIG. 2 is a perspective view of another pair of shoe rack shelves that utilize the heel elevating support.

As shown in FIG. 2, a slightly different rack 10*a* includes a central shaft 18*a* having a plurality of interconnected shaft segments 19*a* and 21*a* that abut at seam 23*a*. A number of shaft segments may be joined to assemble the shaft 18*a*. By adding or subtracting shaft segments, the length of the shaft may be adjusted to fit storage spaces having assorted heights. Any form of known releasable connection may be used to join adjacent shaft segments.

A plurality of shelves, 36, 46 (FIG. 1) and 36*a*, 46*a* (FIG. 2) are secured to shafts 18, 18*a*, respectively, at predetermined intervals. Various numbers of shelves may be employed. Each shelf has a circular configuration and is disposed symmetrically about the shaft such that the shaft extends through a central opening in each of the shelves. Shelves 36, 46, in FIG. 2 and the manner of attaching those shelves to the shaft are described in Patent No. '746. Shelves 36*a*, 46*a*, FIG. 2, may have an identical or slightly altered construction. It should be understood that various shelf configurations and alternative means for fixedly or adjustably mounting the shelves to the shaft may be used. In certain versions, the shelves may be rotatable about the shaft. In such cases a fixed shaft is typically featured.

As illustrated in FIGS. 1 and 2, each shelf includes a generally horizontal platform portion 54, 54*a* that is disposed annularly about shaft 18, 18*a*, respectively. Platform 54, 54*a* has a solid, planar top surface. An annular lip 60, 60*a* is formed peripherally about and is typically integral with the platform.

A heel support 62 is releasably attached to shaft 18, 18*a* above each shelf. As best shown in FIGS. 1 and 2, each heel support 62 includes an annular rail 64 that is disposed about the shaft 18, 18*a*. The rail is supported above platform 54 by an annular fastening collar 66, which is releasably attached directly to shaft 18, 18*a*, and three generally L-shaped spokes 68, which interconnect collar 66 and rail 64. More particularly, as best shown in FIG. 2, each angular spoke 66 includes a horizontal segment 70 that is attached to and extends radially outwardly from collar 66. A second, generally vertical spoke segment 72 interconnects the distal end of segment 70 and rail 64. The second spoke segment extends upwardly from the first segment and thereby holds rail 64 above shelf platform 54 and collar 66. The collar, spokes and rail are preferably unitarily molded or otherwise constructed, although they may comprise separate, interconnected pieces. Known forms of interconnection may be used. A plurality of rubber or plastic bushing 76 are mounted to rail 64 above shelf 46, as shown FIGS. 1 and 3. Such bushings may be used on any of the rails. The function of bushings 76 is described below.

Each heel support 62 is preferably mounted to be adjustable along the shaft. This means that the heel support is releasably connected to the shaft such that it may be moved vertically and re-positioned on the shaft in either an upward or downward direction so that the heels of footwear supported on the underlying shelf may be elevated to a selected or predetermined height. Various known forms of releasably interconnecting the inner collar or other fastener 66 may be utilized. For example, in the versions that are shown herein, a set screw 75 is formed through collar 66. To adjust the position of support 62 along shaft 18 or 18*a*, set screw 75 is loosened and the heel support is raised or lowered to position rail 64 at a desired level. Set screw is then tightened to secure collar 64 and entire support 62 to the rail. Alternative forms of clamps, springs, clips and other mechanisms may be employed in order to releasably attach the collar or other fastener to the shaft in a selected position. Normally, the heel support is raised in order to accommodate larger sizes of shoes such as those worn by men. Conversely, the heel support is lowered for women's and smaller sizes of footwear. The support should be raised high enough so that as shown in FIG. 1, the toe 55 of shoe 51 is confined within the periphery of the shelf, regardless of the shoe size.

The shoe rack of this invention is assembled in a manner analogous to the manner described in patent '746. As each heel support is installed, its position along the shaft is selected in the manner described above in order to accommodate for particular sizes of shoes. Respective groups of shoes are then arranged on the shelves. Each shelf 36, 46 (FIGS. 1 and 3) and 36*a*, 46*a* (FIG. 2) supports groups or pairs of either men's or women's shoes in a generally radial arrangement, i.e. each shoe points radially outwardly relative to the shaft.

Figure 3:
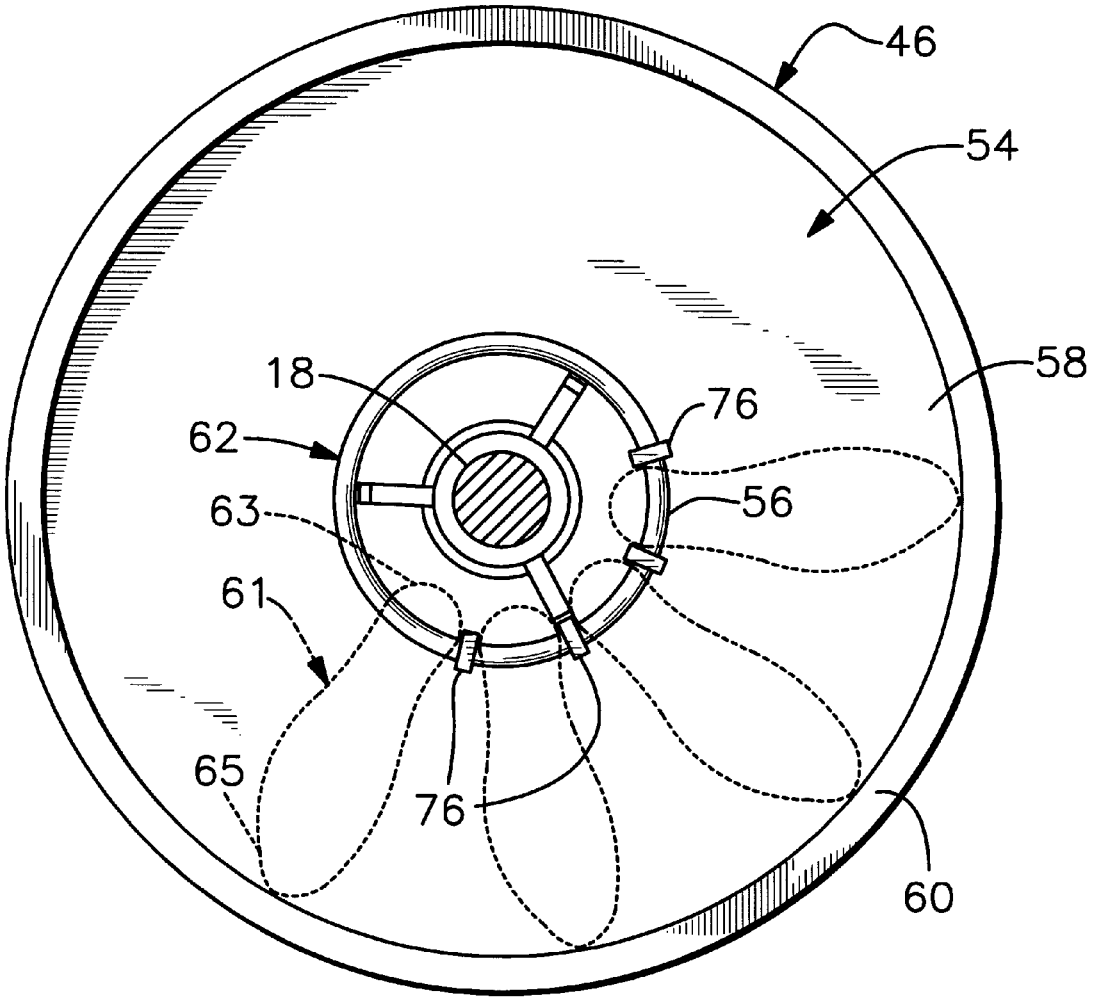
FIG. 3 is a cross sectional view taken along line 3—3 of FIG. 1.

In FIGS. 1 and 3, a high heel shoe 51 is supported on shelf 36. Shoe 51 is pointed generally radially outwardly from its heel portion 53 to its forward or toe portion 55. Heel portion 53 extends over and through rail 64 of heel support 62. As a result, heel portion 53 is elevated above platform 54. Forward shoe portion 55 extends generally outwardly and downwardly and engages an outer section 58 of platform 54. Lip 60 confines shoe 51 to the periphery of shelf 36 and helps to prevent the shoe from slipping or falling off of the shelf. By elevating heel portion 53 above platform 54, proper ventilation is maintained around shoe 51 so that mildew does not collect on the sole of the shoe. Moreover, elevating the heel increases the inner circumference of the arrangement of shoes and therefore permits a greater number of pairs to be accommodated on each shelf.

Flats or similar shoes 61 are supported on shelf 46 in FIG. 1. The heel portion 63 of each shoe 61 engages the rail 64 of heel support 62 and, as a result, heel portion 63 is elevated above platform 54 so that proper circulation is maintained around the shoes and shoe capacity is increased. Forward portion 65 of shoe 61 extends generally outwardly and downwardly from the annular rail 64 and engages outer portion 58 of platform 54. Because heel portion 63 is minimally or virtually level with the remainder of the sole of shoe 61, such shoes have a tendency to slip off of a bare rail 64, such as is used on shelf 36. Employing annular bushings 76 on either side of shoe 61 significantly reduces this problem. Bushings 76 hold the shoe fairly securely in place on or against the rail. Once again, lip 60 confines shoes 61 generally to the periphery of shelf 46 and prevents those shoes from sliding radially off the shelf. Alternatively, releasable clips may be attached to the rail to perform this function. Preferably each of the shelves is spaced approximately 10 inches apart so that unobstructed access to and viewing of the shoes is permitted. This distance may be readily adjusted as required because each of the shelves is fixed to the rotatable shaft, the entire rack may be rotated by turning just one of the shelves. This permits all of the shoes to be quickly and conveniently inspected and accessed during a single rotation of the rack.

By adding or subtracting shelves, varying numbers of shoes may be accommodated. Although it is not a limitation of this invention, a preferred shelf diameter is approximately 20 inches. Such a shelf can comfortably accommodate six pairs of ladies shoes and fit satisfactorily within the space available in most wardrobe closets. Accordingly, a rack that includes six shelves of this type can comfortably accommodate at least 36 pairs of shoes.

Figure 4:
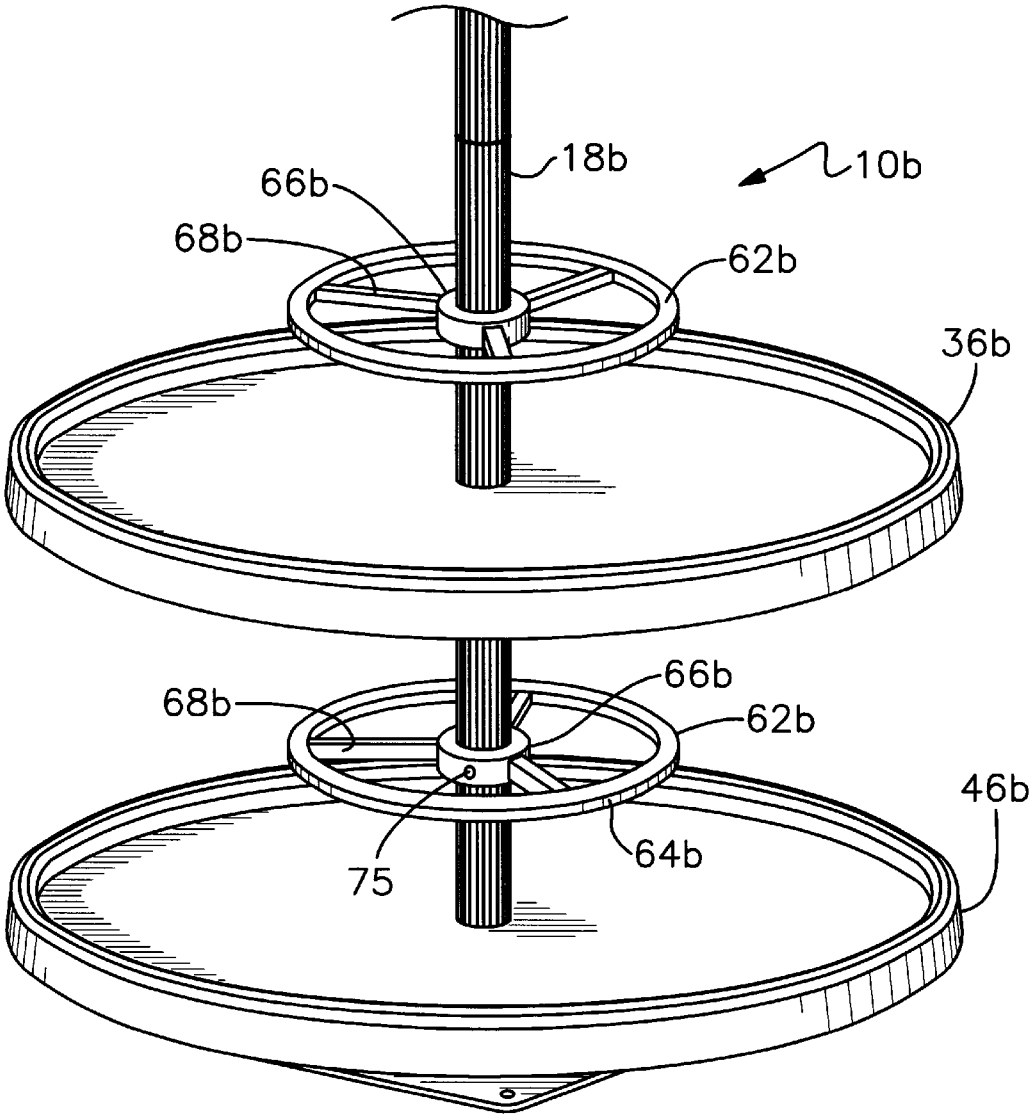
FIG. 4 is a perspective view of a shoe rack utilizing an alternative heel elevating support in accordance with this invention.

An alternative shoe rack 10*b* is shown in FIG. 4. It should be understood that this version of the rack is structurally analogous and operates identically to previously described versions. Indeed, the shaft 18*b* and the shelves 36*b* and 46*b* of this version are identical to the corresponding components in FIG. 2. Other forms of the shaft and shelves may also be utilized. In this embodiment, a heel elevation support 62*b* is again employed for each shelf. As in the previously described versions, support 62*b* comprises an inner annular collar 66*b* that is releasably attached to shaft 18*b* by a set screw 75 or other releasable fastening means. Three spokes 68*b* are connected to and extend radially from each collar 66*b*. The distal end of each spoke 68*b* is joined with an annular or ring-like rail 64*b*, which encircles shaft 18*b*. As a result, rail 64*b* is held above a respective shelf 36*b*, 46*b*. The only difference between this embodiment and the previously described version is the shape of the radial spokes 68*b*. In contrast to the prior version, spokes 68*b* are perfectly straight. Accordingly, rail 64*b* is substantially level with collar 66*b*. Otherwise, this version of the heel support 62*b* is analogous to previously described version. The heel support is adjusted along shaft 18*b* so that the rail is positioned at a selected height. The heel support is then fixed in place along the shaft and the heels of a group of shoes are engaged with the rail so that the heels are elevated above shelf in the above-described manner. The heel support may be vertically adjusted to accommodate differing sizes of shoes.

It should be understood that the heel support might include various other configurations within the scope of this invention. For example, the collar or other fastener may be attached to the shaft above the rail. In such versions, the spokes or other intermediate elements interconnecting the fastener and the rail are angled or otherwise extend downwardly from the central fastener. In any of these versions, the heel support may comprise a unitary, molded plastic piece or multiple interconnected pieces. Instead of a collar, the fastener may comprise other non-annular components. Alternative types of intermediate interconnecting structure may replace the spokes. The rail section may also include configurations other than those shown herein. It need not comprise a narrow elongate element. For example, the support may include a cup-like shape and the rail may be defined by the peripheral upper edge or lip of the cup. The support may extend solidly or continuously from the fastener to the structure forming the rail without any interruptions. In all versions, however, it is important that some structure be employed for engaging and elevating the heels of the shoes placed on the storage rack. It is also critical for the purposes of this invention that the heel support be mounted to the central shaft rather than directly to the shelves as in my previous patent.

Although specific features of the invention are shown some of the drawings and not others, this is for convenience only, as each feature may be combined with any and all of the other features in accordance with this invention.

Other objects will occur to those skilled in the art and are within the following claims:

What is claimed is:

1. In a shoe rack that includes a generally vertically supported shaft and a generally horizontal storage shelf mounted to and disposed about the shaft such that the shaft extends generally centrally through the shelf, the improvement comprising:

a heel elevating support that includes a fastener section attached directly to the shaft above the shelf, a support rail section spaced outwardly from said fastener section and extending at least partly about the shaft, and an intermediate section that interconnects said fastener section and said rail section such that said rail section is supported above the shelf, said fastener section including a generally annular collar that surrounds said shaft;

whereby said rail section is engaged by a heel of a shoe stored on the shelf to elevate and support the heel of the shoe above the shelf.

2. The apparatus of claim 1 in which said generally annular collar carries means for releasably attaching said support to said shaft at a selected position along said shaft.

3. The apparatus of claim 1 in which said rail section includes a ring-like component that surrounds said shaft.

4. The apparatus of claim 1 in which said intermediate section includes a plurality of spokes that interengage said fastener section and said rail section.

5. The apparatus of claim 4 in which each spoke has an angular shape including a first segment that extends radially outwardly from said fastener section and a second segment that is attached to and extends upwardly from a distal end of said first segment, said second segment having a distal end that is attached directly to said rail section.

6. The apparatus of claim 4, in which each spoke has a straight, elongate shape.

7. The apparatus of claim 4 in which said spokes extend radially outwardly from said fastener section.

8. In a shoe rack that includes a generally vertically supported shaft and a generally horizontal storage shelf mounted to and disposed about the shaft such that the shaft extends generally centrally through the shelf, the improvement comprising:

a heel elevating support that includes a fastener section attached directly to the shaft above the shelf, a support rail section spaced outwardly from said fastener section and extending at least partly about the shaft, and an intermediate section that interconnects said fastener section and said rail section such that said rail section is supported above the shelf, said fastener section including a generally annular collar that surrounds said shaft, said generally annular collar carrying means for releasably attaching said support to said shaft at a selected position along said shaft;

whereby said rail section is engaged by a heel of a shoe stored on the shelf to elevate and support the heel of the shoe above the shelf.

9. The apparatus of claim 8 in which said rail section includes a ring-like component that surrounds the shaft.

10. The apparatus of claim 8 in which said intermediate section includes a plurality of spokes that interengage said fastener section and said rail section.

11. The apparatus of claim 10 in which each spoke has an angular shape including a first segment that extends radially outwardly from said fastener section and a second segment that is attached to and extends upwardly from a distal end of said first segment, said second segment having a distal end that is attached directly to said rail section.

12. The apparatus of claim 10 in which each spoke has a straight, elongate shape.

13. The apparatus of claim 10 in which said spokes extend radially outwardly from said fastener section.

14. In a shoe rack that includes a generally vertically supported shaft and a generally horizontal storage shelf mounted to and disposed about the shaft such that the shaft extends generally centrally through the shelf, the improvement comprising:

a heel elevating support that includes a fastener section attached directly to the shaft above the shelf, a support rail section spaced outwardly from said fastener section and extending at least partly about the shaft, and an intermediate section that interconnects said fastener section and said rail section such that said rail section is supported above the shelf, said intermediate section including a plurality of spokes that interengage said fastener section and said rail section, each said spoke having an angular shape that includes a first segment that extends radially outwardly from said fastener section and a second segment that is attached to and extends upwardly from a distal end of said first segment, said second segment having a distal end that is attached directly to said rail section;

whereby said rail section is engaged by a heel of a shoe stored on the shelf to elevate and support the heel of the shoe above the shelf.

15. The apparatus of claim 14 in which said fastener section includes means for releasably attaching said support to said shaft at a selected position along said shaft.

16. The apparatus of claim 14 in which said fastener section includes a generally annular collar that surrounds said shaft.

17. The apparatus of claim 16 in which said generally annular collar carries means for releasably attaching said support to said shaft at a selected position along said shaft.

18. The apparatus of claim 14 in which said rail section includes a ring-like component that surrounds said shaft.

* * * * *